US006899063B2

(12) United States Patent
Obermayer et al.

(10) Patent No.: US 6,899,063 B2
(45) Date of Patent: May 31, 2005

(54) CYLINDER HEAD FOR A MULTICYLINDER LIQUID-COOLED INTERNAL COMBUSTION ENGINE

(75) Inventors: Bertram Obermayer, Hitzendorf (AT); Robert Poeschl, Graz-Andritz (AT)

(73) Assignee: AVL List GmbH, Graz (AT)

( * ) Notice: Subject to any disclaimer, the term of this patent is extended or adjusted under 35 U.S.C. 154(b) by 0 days.

(21) Appl. No.: 10/619,464

(22) Filed: Jul. 16, 2003

(65) Prior Publication Data

US 2004/0173168 A1 Sep. 9, 2004

(30) Foreign Application Priority Data

Jul. 23, 2002 (AT) ..... GM498/2002

(51) Int. Cl.[7] ..... F01P 1/06
(52) U.S. Cl. ..... 123/41.31; 123/41.82 R
(58) Field of Search ..... 123/41.31, 41.74, 123/41.82 A, 41.82 R

(56) References Cited

U.S. PATENT DOCUMENTS 3,818,878 A 6/1974 Zaruba
4,046,114 A * 9/1977 Hamparian et al. ..... 123/41.76
4,083,333 A * 4/1978 Rudert et al. ..... 123/41.82 R

FOREIGN PATENT DOCUMENTS

EP 94982 11/1983
JP 06074041 3/1994
JP 2000310157 11/2000
JP 2001200753 7/2001

* cited by examiner

*Primary Examiner*—Willis R. Wolfe
*Assistant Examiner*—Katrina B. Harris
(74) *Attorney, Agent, or Firm*—Dykema Gossett PLLC

(57) ABSTRACT

A cylinder head for a multi-cylinder liquid-cooled internal combustion engine having a cooling chamber configuration adjacent to a fire deck which is divided by an intermediate deck essentially parallel to the fire deck into a lower cooling chamber next to the fire deck and an upper cooling chamber adjoining the lower one in the direction of the cylinder axis, the lower and upper cooling chamber communicating with each other via at least one first transfer opening, where at least one first transfer opening is provided in the area of an opening receiving a preferably centrally disposed fuel injection device, where at least one coolant inlet per cylinder (A,B,C), which is preferably located in the fire deck, opens into the lower cooling chamber, at least one coolant outlet departs from the upper cooling chamber, where a lower cooling chamber is associated with each cylinder (A,B,C), the lower cooling chambers of at least two adjacent cylinders (A,B,C) are essentially separated from each other by a partitioning wall, the coolant flow in the lower cooling chamber is essentially transverse to the cylinder head, and where the upper cooling chamber extends over at least two cylinders (A,B,C), the first transfer opening being disposed at a distance (a) from the opening receiving the fuel injection device, and the distance (a) between the openings having a defined minimum.

6 Claims, 2 Drawing Sheets

CYLINDER HEAD FOR A MULTICYLINDER LIQUID-COOLED INTERNAL COMBUSTION ENGINE

BACKGROUND OF THE INVENTION

A cylinder head for a multi-cylinder liquid-cooled internal combustion engine, with a cooling chamber configuration adjacent to a fire deck, which is divided by an intermediate deck essentially parallel to the fire deck into a lower cooling chamber next to the fire deck, and an upper cooling chamber adjoining the lower one in the direction of the cylinder axis, where upper and lower chamber communicate with each other via at least one first transfer opening, and where at least one first transfer opening is provided in the area of an opening receiving a preferably centrally disposed fuel injection device, and where at least one coolant inlet per cylinder, which is preferably located in the fire deck, opens into the lower cooling chamber, and at least one coolant outlet departs from the upper cooling chamber, and where a lower cooling chamber is associated with each cylinder and the lower cooling chambers of at least two adjacent cylinders are essentially separated from each other by a partitioning wall and the coolant flow in the lower cooling chamber is essentially transverse to the cylinder head, and where the upper cooling chamber extends over at least two cylinders.

In powerful compression-ignition internal combustion engines with strong heat generation, for example, a single continuous cooling chamber for a coolant passing longitudinally through the cylinder head will not provide sufficient cooling of the fire deck. Insufficient heat transfer from the cylinder head, however, may lead to material deformation, leaks and cracking.

DESCRIPTION OF THE PRIOR ART

In CH 614 995 A a single-cylinder cylinder head for a compression-ignition engine is disclosed, with a lower cooling chamber on the side of the fire deck and an upper cooling chamber, the two cooling chambers being separated by a partition. The coolant is supplied via a feed pipe to annular coolant passages around the valve seats on the one hand, and to the lower cooling chamber on the other hand. From the coolant passages around the valve seats the coolant will flow into a central annular space surrounding a sleeve for a fuel intake device. This is the point from where the coolant will flow into the upper cooling chamber. In this way fire deck and valve seats are to be cooled independently. DE 24 60 972 A1 also discloses a single-cylinder cylinder head with two coolant chambers positioned one above the other, which communicate via openings. Such designs are not suitable for engine cylinder heads for a plurality of cylinders, however.

From U.S. Pat. No. 4,304,199 A a cylinder head for a plurality of cylinders for a compression-ignition engine is known, which is provided with a cooling chamber separated by a dividing wall into a lower and an upper part. Upper and lower part are flow-connected by an arcuate opening partially extending along the circumference of the seat of a fuel injector. Via inlet openings in the fire deck the coolant is passed from the cylinder block into the lower part of the cooling chamber, and from there via said arcuate openings into the upper part. The lower part is designed as a continuous space for several adjacent cylinders, so that a longitudinal flow will be generated as well, at least partially. In the instance of strong heat generation in the combustion chamber, it will not be possible to ensure sufficient heat transfer.

In EP 1 126 152 A2 a cylinder head is described, which has a lower and an upper cooling chamber, where the coolant transfer between lower and upper chamber is effected via an annular gap between an injector nozzle sleeve and an intermediate deck, the entire coolant flow passing through this gap. The disadvantage of this configuration is that thermally critical areas, such as the web areas between two exhaust valves, cannot be cooled individually and hot spots cannot be sufficiently cooled.

JP 06-074041 A discloses a cylinder head with a lower and an upper cooling chamber and a centrally positioned injector nozzle sleeve. Directly adjacent to the sleeve the intermediate deck has a transfer opening in the area of the webs between two exhaust ports. The coolant entering the lower coolant chamber flows radially towards the cylinder axis and enters the upper coolant chamber via the only transfer opening, similar to EP 1 126 152 A2. Although the area between the two exhaust ports is properly cooled, other areas with high thermal loads such as the webs between intake ports and injection device, will not be sufficiently cooled.

U.S. Pat. No. 3,818,878 A discloses a cylinder head with four exhaust ports and two cooling chambers located one above the other, including an intermediate deck between the cooling chambers. Via pipe inserts the coolant flows from the cylinder block into the lower cooling chamber and is first guided centrally between the exhaust ports and around the sleeve receiving the fuel injector, following which it will pass into the upper cooling chamber via transfer ports in the area of the inner sidewalls.

Furthermore, cylinder heads with cooling chambers disposed one above the other are described in publications JP 2000-310157 A and JP 2001-200753 A, where coolant flow through the cooling chambers takes place in longitudinal direction essentially.

SUMMARY OF THE INVENTION

It is the object of the present invention to improve cooling in a cylinder head of the above type in as simple a manner as possible.

This object is achieved in the invention by providing that the transfer opening be disposed at a distance from the opening receiving the fuel injection device, the distance between said openings having a defined minimum, and by disposing at least one first transfer opening in the area of at least one web between intake port and receiving opening and/or exhaust port and receiving opening. The cast or drilled transfer openings are spatially separated and positioned independently of the opening receiving the pipe for insertion of the fuel injector. In this way critical areas may be individually subjected to partial cooling streams and hot spots may be supplied with coolant most efficiently. Preferably, at least two transfer openings are disposed diametrically to the opening receiving the fuel injector.

Transverse flow in the lower cooling chamber may be improved significantly by additionally providing for a second transfer opening in the area of a sidewall of the cylinder head. Uniform cooling of the fire deck and optimum cooling in the area of the webs between intake and exhaust ports may be achieved by providing that only part of the coolant volume passing between lower and upper cooling chamber, i.e. preferably 20 to 40 percent of the entire coolant flow through the two chambers, be delivered through the at least one first transfer opening in the area of the opening receiving the fuel injector.

BRIEF DESCRIPTION OF THE DRAWINGS

The invention will now be explained in more detail with reference to the attached drawings, wherein.

DETAILED DESCRIPTION OF THE PREFERRED EMBODIMENT

Figure 1:
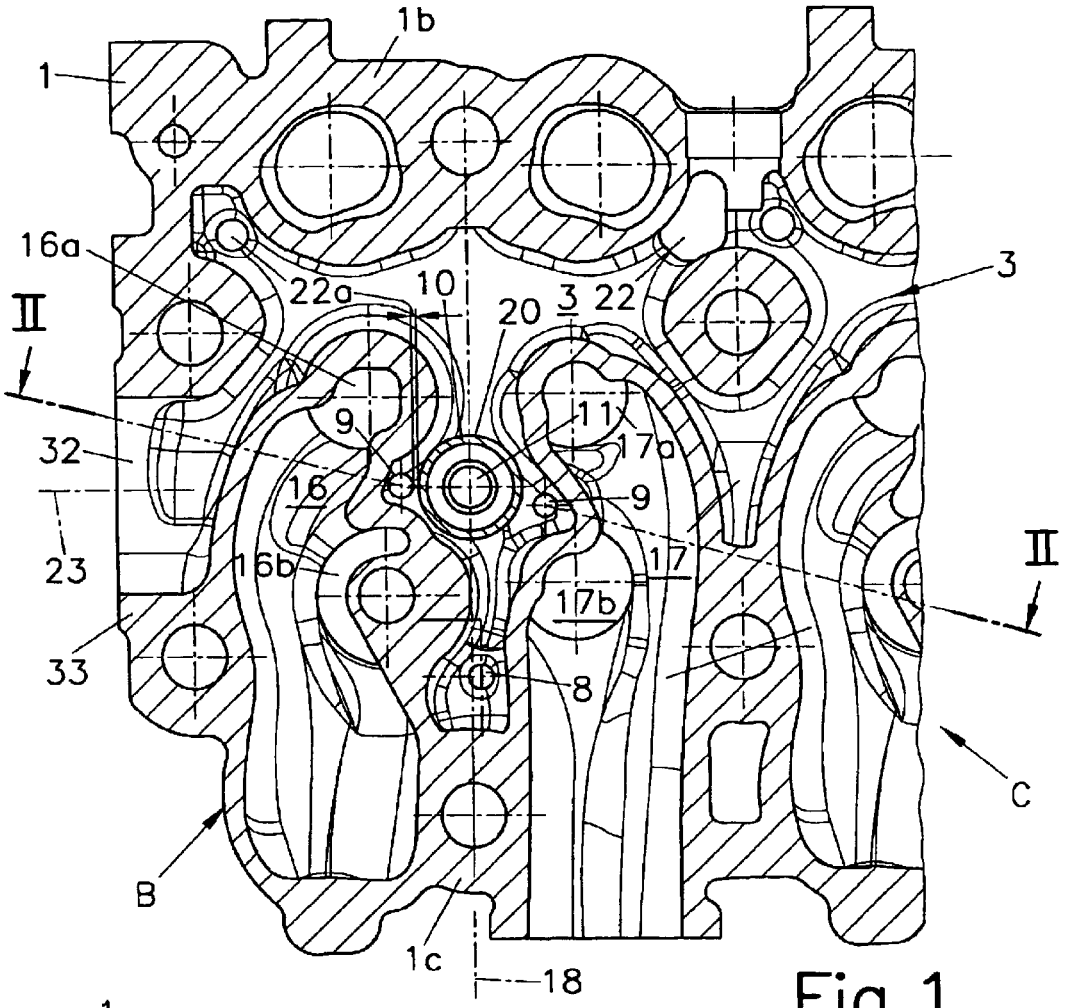
FIG. 1 shows a cylinder head in accordance with the invention, in a cross-section along line I—I in FIG. 2.
Figure 2:
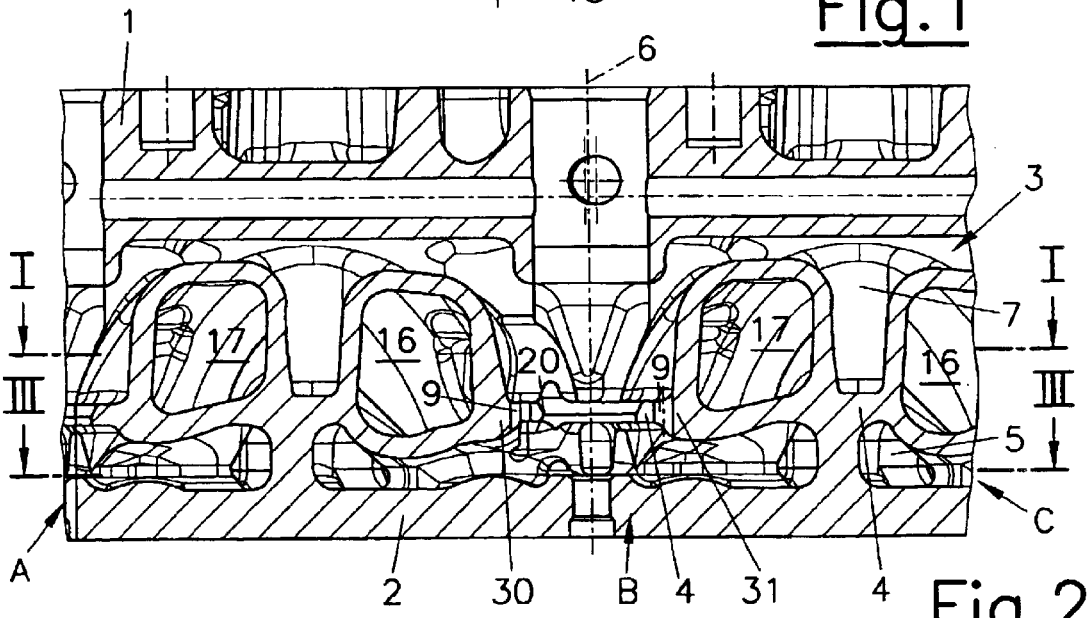
FIG. 2 shows the cylinder head in a cross-section along line II—II in FIG. 1.

The cylinder head 1, which is configured as an integral unit for a plurality of cylinders A,B,C, is characterized by a cooling chamber configuration 3 adjacent to a fire deck 2 on the side of the combustion chamber, which configuration 3 is divided by an intermediate deck 4 into a lower cooling chamber 5 next to the fire deck 2, and an upper cooling chamber 7 adjoining the lower chamber in the direction of the cylinder axis 6. The intermediate deck 4 has at least one first transfer opening 9 for each cylinder A,B,C next to the insertion pipe 10, which pipe 10 is designed to receive a fuel injection device 11. Each first transfer opening 9 is spatially separated from a receiving opening 20 for the insertion pipe 10, with a minimum distance a between the first transfer opening 9 and the receiving opening 20. This separation will permit coolant to be purposefully delivered to the thermally critical areas. The insertion pipe 10 passes through the receiving opening 20 in the intermediate deck 4.

In the variant shown additional second transfer openings 22 are disposed in the area of a sidewall 1*b* of the cylinder head 1. In order to permit venting and the escaping of vapor bubbles from the lower cooling chamber 5 when the engine is tilted, at least one vent 8 is provided for each cylinder A,B,C between the longitudinal engine plane 23 and a sidewall 1*c* of the cylinder head 1, preferably in the area of a transverse engine plane 18 containing the cylinder axis 6.

Optimum cooling of the areas subject to high thermal loads, i.e. the webs 30, 31 between intake port 16 and fuel injection device 11 on the one hand and exhaust port 17 and fuel injection device 11 on the other hand, will be obtained by disposing the first transfer openings 9 in this thermally sensitive region, spatially separated from the opening 20 receiving the fuel injector. Reference numerals 16*a*, 16*b* refer to the intake ports, while 17*a*, 17*b* refer to the exhaust ports.

Figure 3:
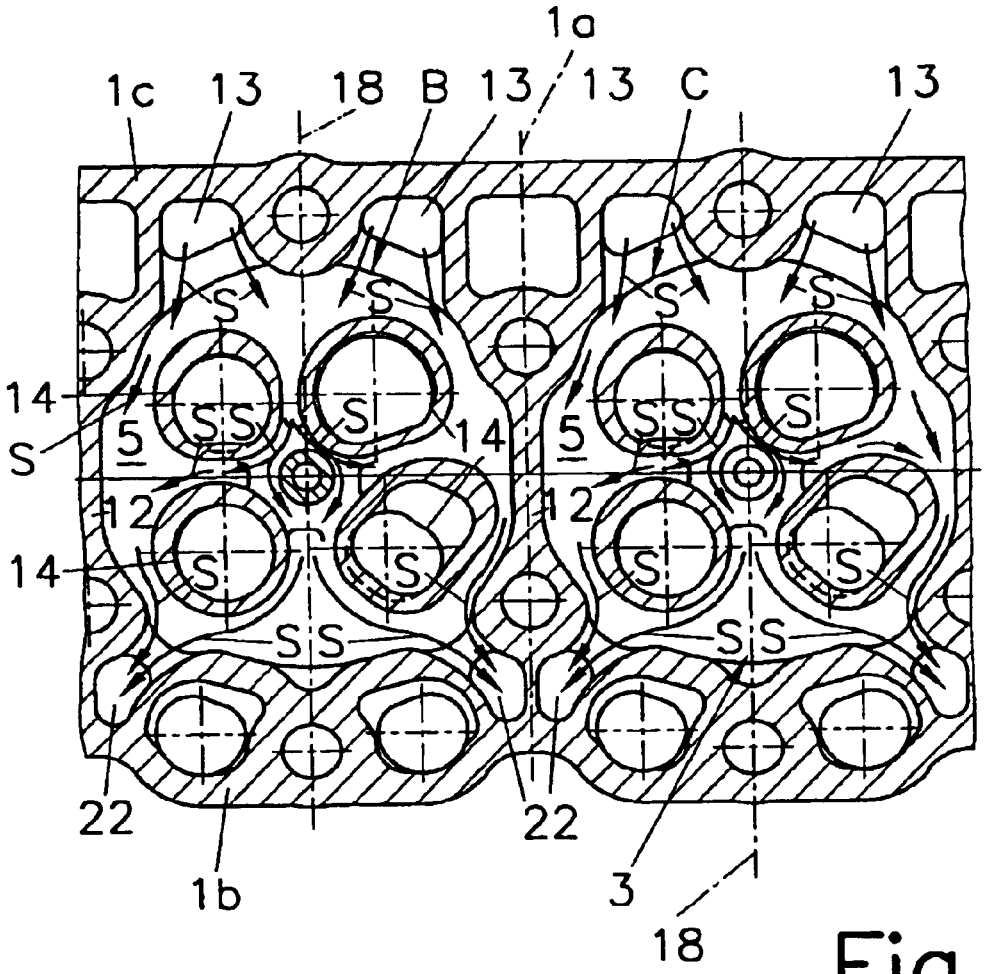
FIG. 3 shows the cylinder head in a cross-section along line III—III in FIG. 2.

The coolant will flow through inlets 13 in the area of the sidewall 1*c* of the cylinder head 1 essentially in transverse direction along arrows S into the lower cooling chamber 5 (FIG. 3). The coolant will flow around the areas surrounding the valve seats 14 of the intake valves and the fuel injector 11, providing for optimum cooling. From the lower cooling chamber 5 the coolant will pass through the first transfer openings 9 and the second transfer openings 22 into the upper cooling chamber 7, and will flow through the upper chamber 7 designed as a single continuous space for all cylinders A,B,C in longitudinal direction of the cylinder head 1. Via at least one outlet 32 the coolant will leave the cylinder head 1. This outlet 32 may be disposed at a front end 33 of the cylinder head 1. Alternatively, the upper cooling chamber 7 may be provided with a collecting rail for the discharged coolant.

As is seen from FIG. 3, the lower cooling chambers 5 of two adjacent cylinders A,B are separated by a partitioning wall 12. Said partitioning walls 12 are located in the area of a transverse engine plane 1*a* in the cylinder head 1.

The first transfer ports 9 are dimensioned so as to permit only 20 to 40 percent, and for instance 30 percent, of the entire coolant volume to flow through these first transfer openings 9. Most of the coolant will reach the upper cooling chamber 7 by way of the second transfer openings 22. In this manner a transverse flow is generated in the lower cooling chamber 5 and optimum cooling of the fire deck 2 is guaranteed.

What is claimed is:

1. Cylinder head for a multi-cylinder liquid-cooled internal combustion engine, with a cooling chamber configuration adjacent to a fire deck, which is divided by an intermediate deck essentially parallel to the fire deck into a lower cooling chamber next to the fire deck and an upper cooling chamber adjoining the lower cooling chamber in the direction of the cylinder axis, wherein lower and upper cooling chambers communicate with each other via at least one first transfer opening, and wherein at least one first transfer opening is provided in an area of an opening receiving a centrally disposed fuel injection device, and wherein at least one coolant inlet per cylinder opens into the lower cooling chamber, and at least one coolant outlet departs from the upper cooling chamber, and wherein a lower cooling chamber is associated with each cylinder and the lower cooling chambers of at least two adjacent cylinders are essentially separated from each other by a partitioning wall and a coolant flow in the lower cooling chamber is essentially transverse to the cylinder head, and wherein the upper cooling chamber extends over at least two cylinders, wherein the first transfer opening and the opening receiving the fuel injection device are spatially separated by a defined minimum distance between the receiving opening and the transfer opening by a portion of the cylinder head, and wherein at least one first transfer opening is disposed in an area of at least one web between intake port and receiving opening and/or exhaust port and receiving opening.

2. Cylinder head according to claim 1, wherein at least two first transfer openings are disposed diametrically to the opening receiving the fuel injector.

3. Cylinder head according to claim 1, wherein a second transfer opening is additionally provided in an area of a sidewall of the cylinder head.

4. Cylinder head according to claim 1, wherein only part of the coolant volume passing between lower and upper cooling chambers is delivered through the at least one first transfer opening in the area of the opening receiving the fuel injector.

5. Cylinder head according to claim 4, wherein 20 to 40 percent of the entire coolant flow through said chambers is delivered through the first transfer opening in the area of the opening receiving the fuel injector.

6. Cylinder head according to claim 1, wherein at least one of the first or second transfer opening is cast or drilled.

* * * * *